US007513541B1

(12) United States Patent
Gregory

(10) Patent No.: US 7,513,541 B1
(45) **Date of Patent: *Apr. 7, 2009**

(54) ROTARY LATCH AND LOCK MECHANISM

(76) Inventor: Shawn Gregory, 18550 Road 26, Dolores, CO (US) 81323

( * ) Notice: Subject to any disclaimer, the term of this patent is extended or adjusted under 35 U.S.C. 154(b) by 0 days.

This patent is subject to a terminal disclaimer.

(21) Appl. No.: 11/605,200

(22) Filed: Nov. 27, 2006

Related U.S. Application Data

(63) Continuation of application No. 10/957,110, filed on Sep. 30, 2004, now Pat. No. 7,140,649.

(51) Int. Cl.
*E05C 3/26* (2006.01)

(52) U.S. Cl. ..... 292/48; 292/198; 292/210; 292/216; 292/DIG. 37; 70/159

(58) Field of Classification Search ..... 292/48, 292/198, 210, 216, DIG. 22, DIG. 37, DIG. 43, 292/DIG. 61; 70/159, 162, DIG. 20
See application file for complete search history.

(56) References Cited

U.S. PATENT DOCUMENTS

| | | | | |
|---|---|---|---|---|
| 2,839,912 | A * | 6/1958 | Corbin et al. | 292/216 |
| 4,273,368 | A * | 6/1981 | Tanaka | 292/48 |
| 5,308,126 | A * | 5/1994 | Weger et al. | 292/DIG. 37 |
| 6,231,091 | B1 * | 5/2001 | Gleason et al. | 292/DIG. 37 |
| 6,454,321 | B1 * | 9/2002 | Parikh | 292/216 |
| 6,540,268 | B2 * | 4/2003 | Pauser | 292/48 |
| 6,755,449 | B2 * | 6/2004 | Weinerman et al. | 292/198 |
| 6,857,298 | B2 * | 2/2005 | Linares | 292/DIG. 37 |
| 7,140,649 | B1 * | 11/2006 | Gregory | 292/198 |
| 2003/0020285 | A1 * | 1/2003 | Kluting et al. | 292/216 |
| 2004/0140678 | A1 * | 7/2004 | Linares | 292/216 |
| 2005/0206172 | A1 * | 9/2005 | Bacon | 292/216 |
| 2006/0006667 | A1 * | 1/2006 | Hidding et al. | 292/216 |

* cited by examiner

*Primary Examiner*—Patricia L Engle
*Assistant Examiner*—Christopher Boswell
(74) *Attorney, Agent, or Firm*—Ramon L. Pizarro; Edwin H. Crabtree

(57) ABSTRACT

A rotary latch mechanism that includes at least one support plate that pivotally supports both a latch fork and a lock cam is disclosed. The lock cam is movable from a first position where the lock cam prevents rotation of the latch fork to a second position where the lock cam does not interfere with the movement of the latch fork. A spring is attached to the latch fork and the lock cam and extends between the latch fork and the lock cam, so that the spring biases the lock cam towards the first position while biasing the latch fork to a release position.

9 Claims, 5 Drawing Sheets

ROTARY LATCH AND LOCK MECHANISM

REFERENCE TO RELATED APPLICATIONS

This application is a continuation of my non-provisional application having Ser. No. 10/957,110, filed Sep. 30, 2004, now U.S. Pat. No. 7,140,649, incorporated herein in its entirety by reference.

BACKGROUND OF THE INVENTION (a) Field of the Invention

This invention generally relates to a rotary jaw latch mechanism used for locking things into place. More particularly, but not by way of limitation, to a single jaw latch mechanism that eliminates the use of bumpers and uses a single external spring for the biasing of both jaws.

(b) Discussion of Known Art

Rotary latch mechanisms are widely used for locks, releasable retention devices, and other applications where a latch mechanism is needed. Examples of these types of mechanisms can be found in U.S. Pat. No. 5,884,948 to Wienerman et al. and U.S. Pat. No. 4,703,961 to Wienerman et al.

A significant limitation of known latch mechanisms is that these designs use springs or other biasing mechanisms that are positioned against the forks or jaws of the latches. Additionally, these devices typically use multiple springs, making the devices more expensive and more likely to fail, as it is well-known that a larger number of components leads to a higher likelihood that one of these components will fail.

Still another disadvantage of known latch mechanisms is that the springs that are used to bias the forks or jaws are installed between the jaws or forks and a cover plate that supports the axles for the jaws. This arrangement is a serious disadvantage of these devices in that it makes it very difficult replace the spring in the event that the spring fails.

Still further, known double jaw or double fork latch mechanisms are typically not adapted for allowing multiple latch mechanism to be actuated from a single location. The ability to release several latch mechanisms from a single location is highly advantageous in that the use of several latch mechanisms that are actuated from a single location creates a much stronger closure or retention of the door or other component being held closed. Still further, the use of multiple latch mechanisms spreads out the lock locations, which prevents the ability of opening of the door panel or cover that is being held closed by flexing the panel at a location that is relatively far away from the single lock location.

Still further, known latching mechanisms are not particularly well suited for use with a pushbutton actuator of the type shown in my U.S. Pat. No. 6,564,602, incorporated herein in its entirety by reference. More particularly, with known devices the pushbutton actuator must be pressed from the same direction as the direction the striker enters the latch mechanism or through a series of pivoting mechanisms. This severely limits the usefulness of these devices with boxes or containers that are opened through a pushbutton. Accordingly, there remains a need for a latch mechanism that is easily used with pushbutton actuation devices.

Therefore, a review of known devices reveals that there remains a need for a simple, reliable, and easily expandable latching system.

There remains a need for a secure latching system that uses few parts and is easy to maintain.

SUMMARY

It has been discovered that the problems left unanswered by known art can be solved by providing a latch mechanism that includes:

at least one support plate;

a latch fork pivotally supported from the support plate;

a lock cam that is pivotally supported from the support plate, the lock cam being movable from a first position where the lock cam prevents rotation of the latch fork to a second position where the lock cam does not interfere with the movement of the latch fork;

a spring, the spring being attached to the latch fork and the lock cam and extending between the latch fork and the lock cam so that the spring biases the lock cam towards the first position while biasing the latch fork to a release position.

It is contemplated that the disclosed invention will be used with a striker that has been adapted to fit into a mouth in the latch fork. Additionally, it is contemplated that the latch mechanism will include a pair of spaced apart plates that define a gap between the plates. An axle that extends between the two plates pivotally supports the latch fork in this gap. An axle that allows the lock cam to rotate also supports the lock cam in the gap. The spring that will be used to bias the latch fork and lock cam will extend between the latch fork and lock cam, biasing these to rotate in opposite directions. Accordingly, the latch fork is biased towards a release position while the lock cam is biased by the same spring to rotate against the latch fork to lock the latch fork in a lock position.

It has been discovered that the disclosed arrangement eliminates the need for the use of bumpers, which are commonly used to force the forks in rotary locks to push the striker out of the lock once the fork is released. Thus, the positioning of the spring between the latch fork and the lock cam eliminates the need for bumpers, while providing the function of the bumpers and the springs commonly found in known rotary locking mechanisms.

Still further, it has been discovered that the disclosed arrangement is inherently more reliable than known dual-fork mechanisms. Increased reliability in function is produced due to the fact that the presence of only one fork that is biased by the same spring that is used to bias the lock cam is used. Double fork rotating locks are susceptible to inadvertent rotation of one fork by an external force, while the other fork remains in the open poison. This inadvertent rotation causes the rotated fork to prevent the striker from entering the lock altogether. Since the disclosed system uses only one fork, it is impossible for this situation to occur with the disclosed invention.

The lock cam of the disclosed invention includes a lever that can be rotated in order to rotate the lock cam and release the fork. According to a preferred embodiment of the invention, the lever is an integral part of the lock cam. Additionally, the lock cam includes a lock surface and a closure surface. The lock surface contacts the latch fork when the lock cam is in the first position and the latch fork is in a lock position to prevent the rotation of the latch fork to the release position. The closure surface is used to close off the mouth of the latch fork when the latch fork is in the closed position. The rotation of the lock cam from the first position where the latch fork is maintained in the lock position to the second position, where the latch fork is released and urged to rotate to release the striker, also moved the closure surface away from the mouth of the latch fork, allowing the release of the striker.

It will be understood that the disclosed mechanism is particularly well suited for operation by a pushbutton, such as the type disclosed in my U.S. Pat. No. 6,564,602. The pushbutton, also referred to as a pushbutton actuator, is mounted on the lid of the box or other panel that is to be locked shut, and positioned such that the depression of the pushbutton pushes against the lever of the lock cam, causing the rotation of the lock cam. Once the lock cam is rotated, the latch fork and is released as described above. This arrangement eliminates the need for cables or rods to unlock a single latch via a single pushbutton or pushbutton lock.

It is also contemplated that the disclosed rotary lock mechanism may be arranged such that a single pushbutton may operate several of the disclosed rotary lock mechanisms. Examples of such an arrangement include applications where the pushbutton lock or other suitable hardware is mounted on the box at one or more points along with a latch or multiple latches and the striker or multiple strikers are mounted on the lid. This situation would incorporate rods or cables. In situations where multiple pushbutton locks or other suitable hardware is employed a pivoting mechanism would need to be incorporated in the rod assembly.

Thus, it will be understood that the disclosed system allows the pushbutton, pushbutton lock and the latch mechanism to be mounted on the lid of the box.

Still further, because the pushbutton and the disclosed latch mechanism may be mounted on a single panel, such as the lid of a box, the disclosed system eliminates alignment problems associated with situations where the latch is mounted on the box and the pushbutton lock is mounted on the lid.

It will be understood that the disclosed system is ideal for applications where it is impractical to mount the lock on the box. For example, the disclosed system will allow the use of pushbutton activation to situations where the box is countersunk into a truck bed body and only the lid is exposed.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 2:
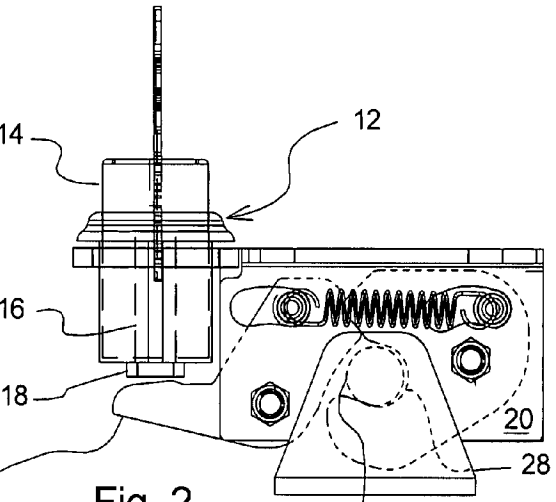
FIG. 2 is a side view of the arrangement shown on FIG. 1.
Figure 1:
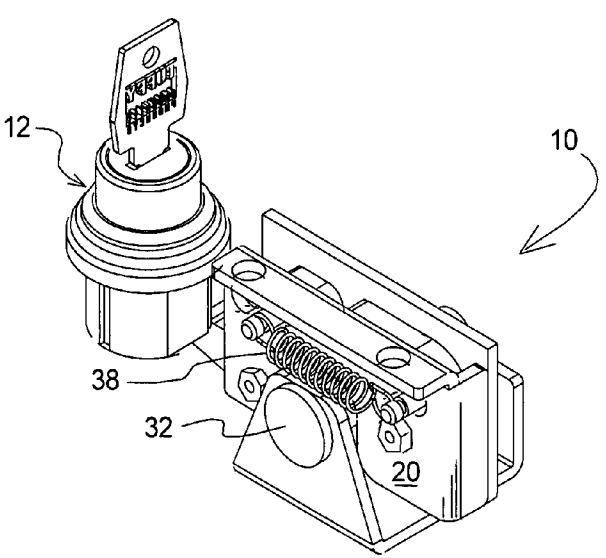
FIG. 1 is a perspective view of an embodiment of the disclosed invention while in use with a pushbutton lock.

Turning now to FIGS. 1 and 2 where a latch mechanism 10 using the disclosed invention has been illustrated while in use with a pushbutton lock 12. It is contemplated that the latch mechanism 10 will be operated through a pushbutton 14 that when pushed down will caused the downward movement of an actuator 16, which in a preferred embodiment is a pivotable cam 18 that is moveable from a locking position where pushing of the pushbutton 14 does not cause the pivotable cam 18 to contact the latch mechanism 10 to an unlocked position where pushing of the pushbutton 14 causes the pivotable cam 18 to release or operate the latch mechanism 10.

Figure 3:
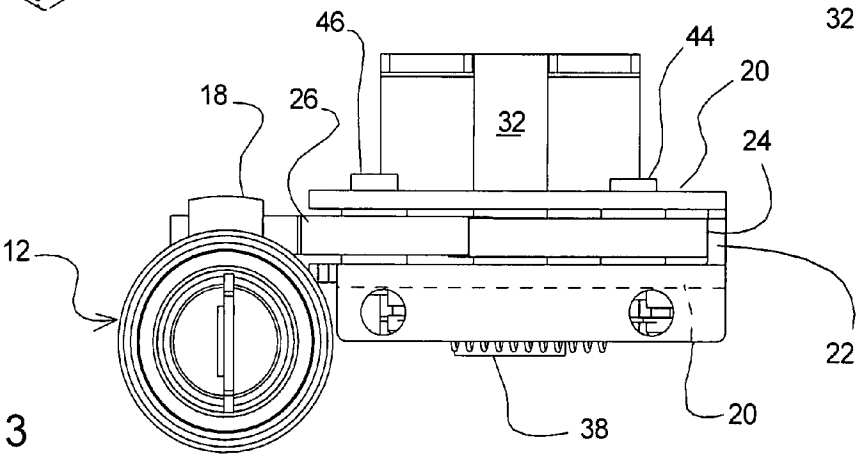
FIG. 3 is a top view of the arrangement shown on FIG. 1.
Figure 4:
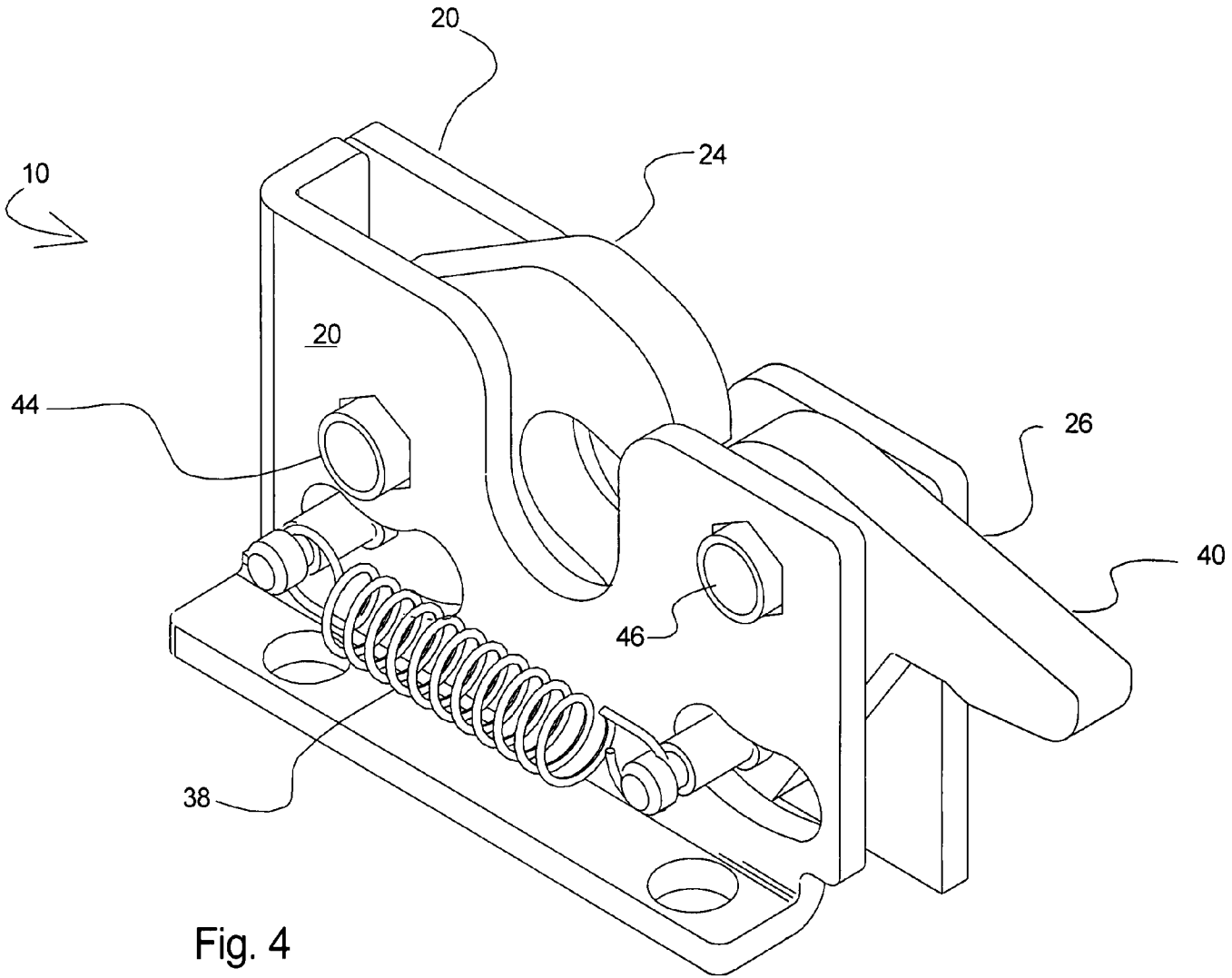
FIG. 4 is a close-up perspective view of the disclosed invention.

Turning now to FIG. 3 it will be understood that it is contemplated that the disclosed latch mechanism will include at least one support plate 20. According to a preferred example of the invention the latch mechanism will use two spaced apart support plates 20 that define a gap 22 between the support plates 20. Additionally, a latch fork 24 that is pivotally supported from the support plate 20, and preferably housed within the gap 22 while being supported on both sides by the support plates 20.

The latch fork 24 will cooperate with a lock cam 26 that is also pivotally supported from the support plate 20, and preferably supported on both sides within the gap by the support plates 20. The lock cam 26 will perform several functions, two important functions being (1) the locking or preventing of rotation of the latch fork 24 and (2) the retention of the striker 32 with the mouth portion 28.

The locking or preventing of rotation of the latch fork 24 occurs when the latch fork 24 is in a lock position, illustrated in FIGS. 1-4, 5A, and 6. When the latch fork 24 is in this lock position, the latch fork 24 will be in its first position, illustrated in FIGS. 1-4, 5A, and 6, with the lock surface 34 positioned against a mating lock face 36 on the latch fork 24. The engagement of the lock face 36 with the lock surface 34 will prevent the rotation of the latch fork 24, and thus maintain the latch fork 24 in the lock position.

When the latch fork 24 is in the lock position, the closure portion 30 of the latch fork 24 blocks off the mouth portion 28 of the latch fork 24 so that the latch fork 24 can securely retain a striker 28 within the latch fork's mouth portion 28. However, when the lock cam 26 is in a second position, illustrated in FIG. 5B, the lock surface of the lock cam 26 does not interfere with the movement of the latch fork 24, and thus allows the latch fork 24 to rotate to a release position, illustrated in FIG. 5D. Additionally, when the lock cam 26 is in the second position, the closure portion 30 moves away from the mouth 28 of the latch fork 24 to facilitate the release of the striker 32 from the mouth 28 of the latch fork.

Also illustrated in FIGS. 1-4 and 5A is that the disclosed system will preferably use a spring 38 that is attached to and between the latch fork 24 and the lock cam 26 so that the spring biases the lock cam 26 towards the first position while biasing the latch fork 24 to the release position. As explained above, the cooperation of the lock surface 34 (which is on the lock cam 26) and the lock face (which is on the latch fork 24) during engagement of these two parts prevents the lock cam 26 from rotating to the second position, which also prevents the latch fork from moving to the release position.

Figure 5A:
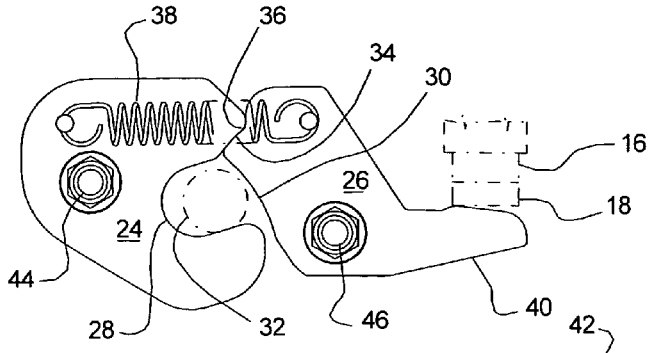
FIG. 5A illustrates the cooperation of the latch fork, lock cam, spring, striker and pushbutton. The support plates have not been shown for clarity.

Turning now to FIGS. 5A-5D, it will be understood that the disclosed rotary latch mechanism 10 will be used to retain the striker 32 when the latch fork 24 is in the lock position, illustrated in FIG. 5A. Also shown in these figures is that it is contemplated that the latch mechanism 10 will be released through use of the actuator 16 of the pushbutton lock 12. Preferably, the actuator 16 will include the pivotable cam 18 that will be operated by the locking system incorporated into the pushbutton lock 12.

Figure 5B:
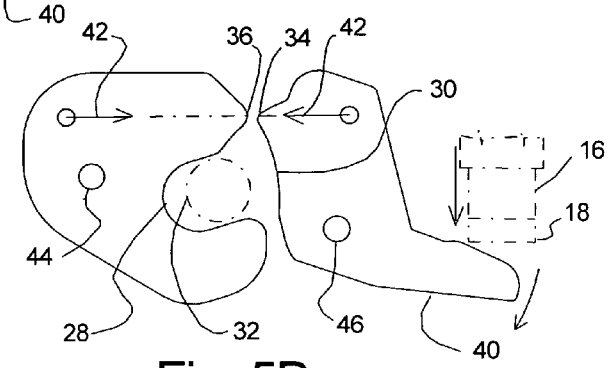
FIG. 5B illustrates the cooperation of the cooperation of the latch fork, lock cam, striker and pushbutton as the pushbutton is pressed and the cam on the pushbutton moves the lever on the lock cam.

As shown in FIG. 5B, the pushing down of the pushbutton 14 results in the pushing down of the actuator 16 and the pivotable cam 18. When the pushbutton lock 12 is unlocked and pushed in, the pivotable cam 18 will contact the lever 40 of the lock cam 26 and begin to push on the lever 40, causing the lock cam 26 to rotate. FIG. 5B also shows that once the lock cam 26 has been rotated such that the lock face 36 clears the lock surface 34 of the lock cam 26, the force 42 imposed by the spring 38 causes the latch fork 24 to rotate about the fork support shaft 44. The fork support shaft 44 provides pivotal support for the latch fork 24 from the support plate 20. Preferably, the support shaft 44 will be mounted between a pair of support plates 20, pivotally supporting the latch fork 24 within the gap 22.

Figure 5C:
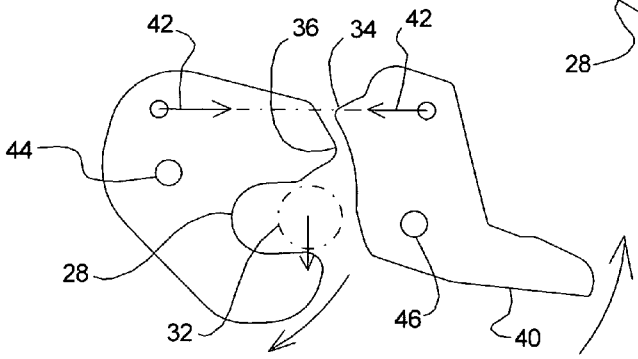
FIG. 5C illustrates the movement of the latch fork once it has been released by the lock cam.
Figure 5D:
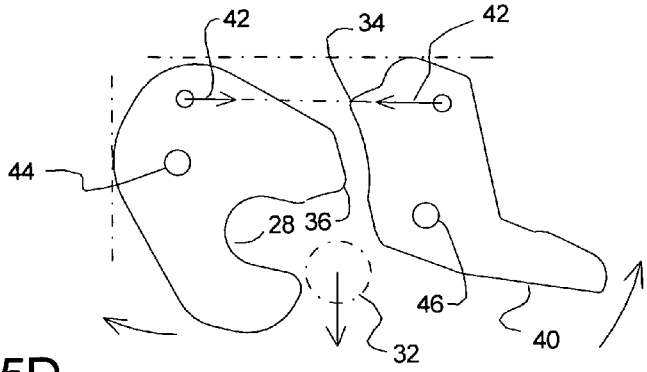
FIG. 5D illustrates the release of the striker.

Turning to FIGS. 5C and 5D it will be understood that the striker 32 will be released from the mouth 28 of the latch fork 24 once the lock face 36 clears the lock surface 34 and the latch fork 24 begins to rotate under the force of the spring 38. Importantly, the ejection of the striker 32 will be accomplished without the use of bumpers and with the use of a single spring 38.

It is further contemplated that the lock cam 26 will be mounted from a lock cam support shaft 46. The lock cam support shaft 46 will support the lock cam 26 from one, and preferably a pair of support plates and allow rotation of the lock cam 26 as described above. According to a highly preferred embodiment of the invention at least one of the support plates 20 will be mounted between the spring 38 and the latch fork 24. It is also contemplated that a single support plate 20 may be used and the fork support shaft 44 and the lock cam support shaft 46 cantilevered from this plate while the spring 38 is attached to the latch fork 24 and the lock cam 26 on the side of latch fork 24 that is opposite to the support plate 20. However, this arrangement is disfavored due to the synergistic results achieved using a pair of spaced apart support plates 20.

Figure 6:
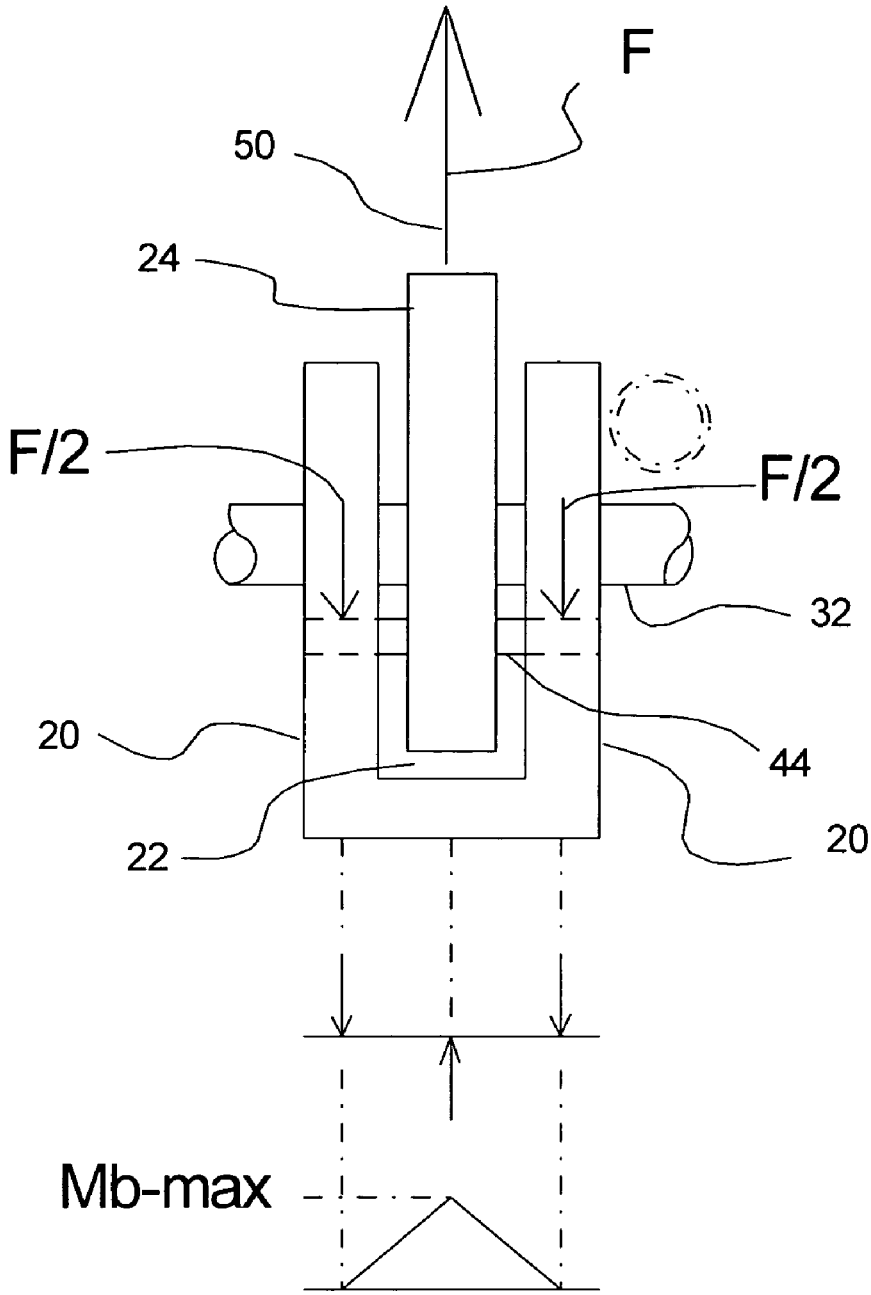
FIG. 6 illustrates the forces on the support shaft and related shear and bending diagram for the support shaft.

Synergistic effects will be understood by turning to FIG. 6 where a schematic of the fork support shaft has been shown while under a load 50 from someone trying to release the striker 32 by pulling on a box-lid or other device that is being held closed through the use of the latch mechanism 10. The use of a pair of spaced-apart support plates 20 will minimize the bending moment (Mb) on the fork support shaft 44. Furthermore, by positioning the spring 38 outside of the gap 22, the support plates 20 can be positioned closer to one another, and thus minimizing the bending moment on the support shafts. Accordingly, FIG. 6 includes a free-body diagram of the forces on the support shafts and illustrates the magnitude of the bending moments experienced by the support shafts. FIG. 6 shows that the maximum bending moment (Mb-max) is equal to the reaction forces times the distance along the fork support shaft 44. Thus reducing the distance or length of the support shafts, such as the fork support shaft 44 and the lock cam support shaft 46, reduces the bending moment.

Figure 7:
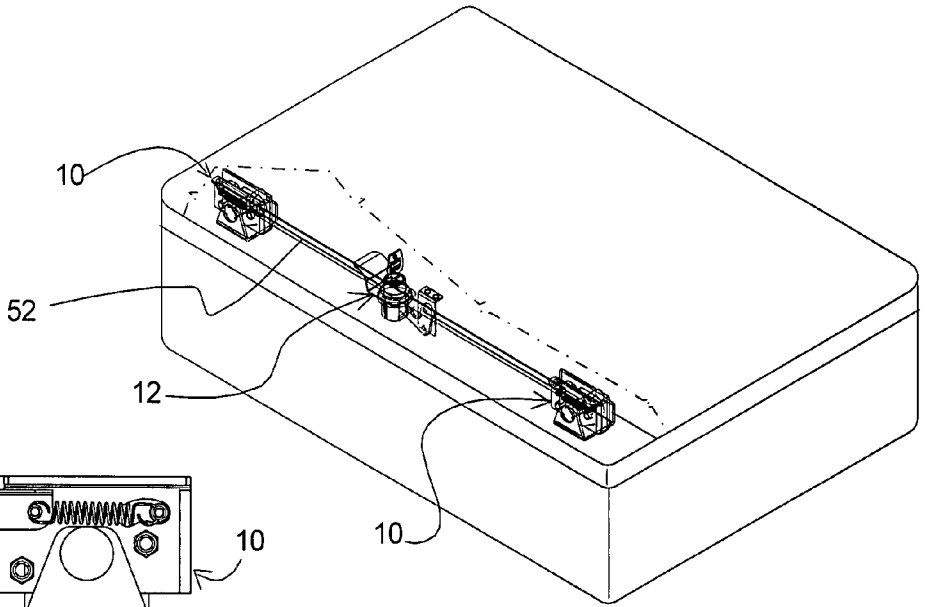
FIG. 7 illustrates the linking of a pair of latch mechanisms that are activated with a single pushbutton.
Figure 9:
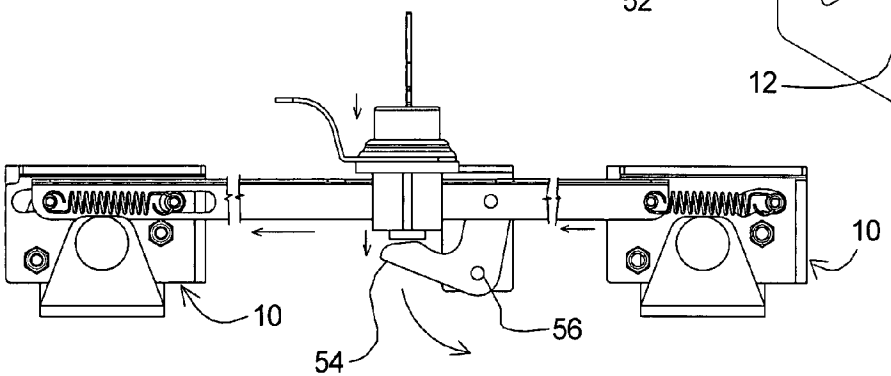
FIG. 9 is a side view of the linkage arrangement shown in use on FIG. 7.
Figure 8:
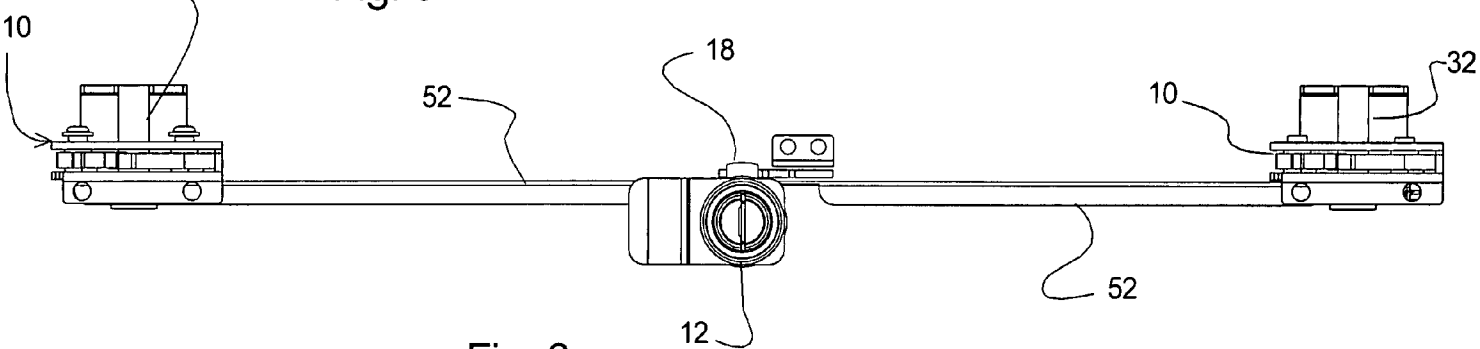
FIG. 8 is a top, plan view of the linkage arrangement shown in use on FIG. 7.

Turning now to FIGS. 7 through 9 it will be understood that the disclosed latch mechanism 10 is particularly well suited for use in multiple units per application. In other words, several of the latch mechanisms 10 can be linked together with a rod 52. The rod 52 will in turn be positioned such that the rotatable cam 18 of the pushbutton lock 12 is moved when the rotatable cam 18 is in the unlocked position. Thus pressing down on the pushbutton 14 will cause the lever 54 to pivot about pivot point 56 and the rod 52 to move the lever 40 of the lock cam 26 of each of the latch mechanisms 10, and thus releasing multiple latch mechanisms 10 at once.

The use of multiple latch mechanisms 10 along the same lid, panel, or item being locked distributes the forces of someone trying to open the box over the several latch mechanisms. Accordingly, the ability to link these latch mechanisms together results in a stronger system than known pushbutton systems. It is important to note that while the illustrated example shows the use or a rod 52 as an actuation connector, it is also contemplated that items such as cables, chains, or other flexible members may also be used as an actuation connector.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A latch actuation mechanism for actuation with a single pushbutton, the mechanism comprising:

a pair of latches, each latch comprising:

at least one support plate;

a latch fork pivotally supported from the support plate;

a lock cam that is pivotally supported from the support plate, the lock cam being movable from a first position where the lock cam prevents rotation of the latch fork to a second position where the lock cam does not interfere with the movement of the latch fork;

a spring, the spring being attached to the latch fork and the lock cam and extending between the latch fork and the lock cam, with the support plate being mounted between the spring and the latch fork, so that the spring biases the lock cam towards the first position while biasing the latch fork to a release position; and a rod that extends from each lock cam, the rod being mounted from a rotating lever to create translation motion along the rod as well as translation of the rod about the rotating lever, the rotating lever being adapted for rotating about a pivot point in response to the pressing of the pushbutton, so that the rotation of the lever moves the rod to simultaneously move both of the lock cams to the second position.

2. A latch actuation mechanism according to claim 1 that is connected to a pushbutton actuator, the pushbutton actuator being connected to the rotating lever so that the lock cam of at least one of said latches moves from the first position to the second position in response to the pushing of the pushbutton actuator.

3. A latch actuation mechanism according to claim 1 wherein said at least one support plate of at least one of said latches comprises a pair of spaced apart support plates.

4. A latch actuation mechanism for actuation with a single pushbutton, the mechanism comprising:

a pair latches, each latch comprising:

a pair of spaced apart support plates, the spaced apart support plates defining a gap therebetween, at least one of the plates having a slotted aperture;

a latch fork pivotally supported from the support plates and positioned in the gap between the support plates;

a lock cam that is pivotally supported from the support plates and positioned in the slot, the lock cam being movable from a first position where the lock cam prevents rotation of the latch fork to a second position where the lock cam does not interfere with the movement of the latch fork;

a spring, the spring being positioned next to the slotted aperture and outside of the gap, the spring being attached to the latch fork and the lock cam so that the spring biases the lock cam towards the first position while at the same time biasing the latch fork to a release position, so that the movement of the lock cam to the second position allows the spring to move the latch fork to the release position; and a rod that extends from each lock cam, the rod being mounted from a rotating lever, the rotating lever being adapted for rotating about a pivot point in response to the pressing of the pushbutton, so that the rotation of the lever moves the rod to simultaneously move both of the lock cams to the second position.

5. A latch actuation mechanism according to claim 4 wherein said latch fork includes a mouth that is adapted for accepting a striker, and said lock cam includes a closure portion that closes the mouth when the latch fork is in said first position.

6. A latch actuation mechanism according to claim 4 and further comprising a pushbutton lock, the pushbutton lock having a pushbutton that is connected to the rotateable lever, so that pushing of the pushbutton causes said pivotable cams to move the lock cams to said second position, so that the latch fork of each latch is free to be moved by the spring.

7. A latch actuation mechanism according to claim 6 wherein said rotatable lever moves the actuation rod in response to the pushing of the pushbutton only when the pivotable cam is in the unlocked position, the actuation rod being connected at least at least one lock cam, so that pushing pushbutton while the pivotable cam is in the unlocked position causes actuation rod to move the at least one lock cam to move to the second position.

8. A pusbutton operated latching system, the latching system comprising:

a pushbutton;

at least one striker;

at least one latch mechanism adapted for cooperating with the at least one striker, the at least one latch mechanism comprising:

a pair of spaced apart support plates, the spaced apart support plates defining a gap therebetween, at least one of the plates having a slotted aperture;

a latch fork pivotally supported from the support plates and positioned in the gap between the support plates, the latch fork being adapted for accepting the striker and pivoting from a lock position where the striker is retained by the latch fork to a release position where the striker is released from the latch fork;

a lock cam that is pivotally supported from the support plates and positioned in the slot, the lock cam being movable from a first position where the lock cam prevents rotation of the latch fork to a second position where the lock cam does not interfere with the movement of the latch fork;

a spring, the spring being positioned next to the slotted aperture and outside of the gap, the spring being attached to the latch fork and the lock cam so that the spring biases the lock cam towards the first position while at the same time biasing the latch fork to a release position, so that the movement of the lock cam to the second position allows the spring to move the latch fork to the release position; and and a rod that extends from each lock cam, the rod being mounted from a rotating lever, the rotating lever being adapted for rotating about a pivot point in response to the pressing of the pushbutton, so that the rotation of the lever moves the rod to simultaneously move both of the lock cams to the second position.

9. A latching system according to claim 8 wherein each of said at least one latch fork includes a mouth that is adapted for accepting a striker, and said lock cam includes a closure portion that closes the mouth when the latch fork is in said first position.

* * * * *